US008667618B2

(12) United States Patent
Pierini et al.

(10) Patent No.: US 8,667,618 B2
(45) Date of Patent: Mar. 11, 2014

(54) HELMET

(75) Inventors: Marco Pierini, Florence (IT); Niccolò Baldanzini, Florence (IT); Antonio Scippa, Monterchi (IT); Francesco Lorenzi, Florence (IT); Roberto Parissenti, Sedico (IT)

(73) Assignees: Dainese S.p.A., Molvena (Vicenza) (IT); Universita' Degli Studi di Firenze, Florence (IT)

( * ) Notice: Subject to any disclaimer, the term of this patent is extended or adjusted under 35 U.S.C. 154(b) by 65 days.

(21) Appl. No.: 13/056,114

(22) PCT Filed: Aug. 7, 2009

(86) PCT No.: PCT/IB2009/053455

§ 371 (c)(1),
(2), (4) Date: Oct. 5, 2011

(87) PCT Pub. No.: WO2010/016032

PCT Pub. Date: Feb. 11, 2010

(65) Prior Publication Data

US 2012/0066818 A1 Mar. 22, 2012

(30) Foreign Application Priority Data

Aug. 8, 2008 (IT) ..... RM2008A0450

(51) Int. Cl.
*A42B 3/00* (2006.01)

(52) U.S. Cl.
USPC ..... 2/411; 2/414

(58) Field of Classification Search
USPC ..... 2/410, 411, 412, 414, 424, 425, 6.8, 9
See application file for complete search history.

(56) References Cited

U.S. PATENT DOCUMENTS 3,897,598 A * 8/1975 Bednarczuk et al. ..... 2/9
4,042,974 A * 8/1977 Morgan et al. ..... 2/9
4,665,569 A * 5/1987 Santini ..... 2/425

(Continued)

FOREIGN PATENT DOCUMENTS

DE 4005278 8/1991
DE 4005278 A1 * 8/1991 ..... A42B 3/08

(Continued)

OTHER PUBLICATIONS

PCT International Search Report for PCT/IB2009/053455 filed on Aug. 7, 2009 in the name of Dainese S.P.A.

(Continued)

*Primary Examiner* — Khoa Huynh
*Assistant Examiner* — Andrew W Collins
(74) *Attorney, Agent, or Firm* — Steinfl & Bruno LLP

(57) ABSTRACT

A helmet (1, 100, 200) for protecting a user's head (90), comprising a cap (2) for protecting the user's cranium (92) and a chin guard (3) for protecting the user's chin (93), wherein the chin guard (3) is adapted to move between a first protecting position (31) and a second protecting position (32) under the action of a force (50) acting in the direction of the chin (93) of a user wearing on said helmet (1), the chin guard (3) in said second protecting position (32) being nearer to the user's chin (93) with respect to the chin guard (3) in said first protecting position (31).

17 Claims, 6 Drawing Sheets

(56) References Cited

U.S. PATENT DOCUMENTS

| | | | | |
|---|---|---|---|---|
| 4,689,836 | A * | 9/1987 | Vitaloni | 2/424 |
| 4,766,615 | A * | 8/1988 | Morin et al. | 2/421 |
| 4,769,857 | A * | 9/1988 | Cianfanelli et al. | 2/424 |
| 4,947,490 | A * | 8/1990 | Hayden | 2/424 |
| 5,093,939 | A * | 3/1992 | Noyerie et al. | 2/424 |
| 5,483,699 | A * | 1/1996 | Pernicka et al. | 2/9 |
| 5,561,866 | A * | 10/1996 | Ross | 2/410 |
| 5,619,755 | A * | 4/1997 | Casartelli | 2/424 |
| 5,675,875 | A * | 10/1997 | Servatius | 24/704.1 |
| 5,787,513 | A * | 8/1998 | Sharmat et al. | 2/411 |
| 5,963,990 | A * | 10/1999 | White | 2/424 |
| 6,378,140 | B1 * | 4/2002 | Abraham et al. | 2/411 |
| 6,418,564 | B1 * | 7/2002 | Sheridan | 2/425 |
| 6,446,270 | B1 * | 9/2002 | Durr | 2/412 |
| 6,691,325 | B1 * | 2/2004 | Pelletier et al. | 2/425 |
| 7,254,843 | B2 * | 8/2007 | Talluri | 2/411 |
| 7,607,179 | B2 * | 10/2009 | Shih | 2/411 |
| 8,146,177 | B2 * | 4/2012 | Mangone | 2/417 |
| 8,176,574 | B2 * | 5/2012 | Bryant et al. | 2/424 |
| 2003/0005510 | A1 * | 1/2003 | Tanaka | 2/410 |
| 2007/0151003 | A1 * | 7/2007 | Shih | 2/424 |
| 2008/0163410 | A1 * | 7/2008 | Udelhofen | 2/413 |
| 2009/0031483 | A1 * | 2/2009 | Wallerberger | 2/421 |
| 2011/0004980 | A1 * | 1/2011 | Leatt et al. | 2/424 |
| 2011/0209272 | A1 * | 9/2011 | Drake | 2/411 |

FOREIGN PATENT DOCUMENTS

| | | |
|---|---|---|
| DE | 4007717 | 9/1991 |
| EP | 0097285 | 1/1984 |
| WO | 90/05464 | 5/1990 |
| WO | 90/05465 | 5/1990 |
| WO | 2007/042930 | 4/2007 |

OTHER PUBLICATIONS

Response to the Written Opinion of European Application No. 09786844.2 filed on Apr. 28, 2011 in the name of Dainese S.p.A.
PCT Written Opinion for PCT/1B2009/053455 filed on Aug. 7, 2009, in the name of Dainese S.P.A.
PCT International Preliminary Report on Patentability for PCT/IB2009/053455 filed on Aug. 7, 2009, in the name of Dainese S.P.A.

* cited by examiner

HELMET

CROSS REFERENCE TO RELATED APPLICATIONS

The present application is the US national stage of International Application PCT/IB2009/0053455 filed on Aug. 7, 2009 which, in turn, claims priority to Italian Patent Application RM2008A000450 filed on Aug. 8, 2008.

The present disclosure relates to a helmet, in particular to a helmet for protecting a user's head. Said helmet can be applied above all in motorcycle field, automotive field, skiing field, in dynamic sports, or generally in sports or working activities entailing the risk of injuries to a person's head following an impact.

"Integral" type protecting helmets are known; these helmets fully enclose the user's head and therefore enclose both the cranium and the chin region.

Such helmets appear as a substantially rigid body, in fact being manufactured with a single molding operation. In particular, they comprise, in one body, a cap for protecting the cranium and a chin guard for protecting the chin.

Moreover, in integral helmets there is the risk that, in case of accident, impacts suffered on the chin guard of the helmet may have an adverse consequence on the user's head.

In fact, owing to the rigidity of the integral helmets, it is reasonable to reckon that, in case of accident, an impact force acting on the chin guard be almost completely transmitted to the remainder of the helmet and from there to the user's head and neck, entailing possible consequent injuries. Moreover, a part of the force might be shifted onto the mandible via the helmet strap, in this case as well entailing the risk of injuries and fractures.

Furthermore, openable helmets are available on the market, in which the chin guard is movable and can be displaced between a position covering the user's chin and a position in which the chin guard is in the region of the user's forehead, then leaving the chin uncovered. However, openable helmets entail the drawback that the chin guard is not always able to effectively protect the user's chin in case of impact, owing to a substantial structural weakness thereof.

Moreover, known-art openable helmets entail drawbacks analogous to the ones noticed above for integral helmets with reference to transmission of the impact force, as their behavior in case of impact on the chin guard is substantially equivalent to that of integral helmets.

Therefore, the known art reveals the need to improve safety and protection capacity of helmets provided with chin guard, in particular in case of knocks or impacts involving the chin guard.

Moreover, the known art reveals the need for said safety improvement to be carried out simply and cheaply, and without jeopardizing a standard functionality of the helmet.

The technical problem providing the starting point for the present disclosure is therefore that of providing a protecting helmet which is able to meet one or more of the needs mentioned above with reference to the known art and/or which is able to achieve further advantages.

This is obtained by providing a helmet for protecting a user's head, as defined in independent claim 1.

Secondary characteristic features of the above-mentioned helmet are defined in the corresponding dependent claims.

The above-described embodiment allows to reduce force and acceleration transmitted from the chin guard to the remainder of the helmet, since the chin guard is not integral with the cap and therefore it is structurally independent from the cap. The chin guard is connected to the cap so as to have a certain degree of relative motion with respect to the latter. In fact, the chin guard has a first protecting position, corresponding to standard use of the helmet, and a second protecting position, to which it tends following an impact in the direction of the chin guard, i.e. of the chin. In case of impact, the chin guard is displaced toward the rear bottom portion of the cap; therefore it nears the user's chin, whereas the remainder of the cap remains substantially stationary with respect to the user. Therefore, the helmet according to the present disclosure does not behave like a rigid body, which almost completely transmits forces and accelerations; on the contrary, the helmet comprises at least two portions that are structurally independent and connected each other, such as cap and chin guard, wherein the chin guard is movable with respect to the cap, so as to allow to limit energy transfer from the chin guard to the remainder of the helmet. Safety and protection capacity in case of impact are therefore increased with respect to known-art helmets.

Moreover, this embodiment results in a higher protection in case of a front impact. In addition, it allows to cushion as much as possible the forces that might transfer to the spine transversally thereto, therefore potentially the most injurious ones. Preferably, the helmet comprises a damper member associated with the chin guard which, during the motion between the first and the second protecting position, cooperates with the chin guard to at least partly absorb mechanical energy due to action of the acting force. Thus, at least a part of the energy generated by the acting force, e.g. in case of an impact, is absorbed by said damper member and therefore it is not transmitted to the remainder of the helmet, further reducing the risk of injuries.

In a particular embodiment, the damper member is of compressible type, like, e.g., a substantially bellows-shaped member, and it is intended to be subjected to a compressive action during a displacement of the chin guard between the two protecting positions. This benefits a certain manufacturing simplicity and a more effective cooperation between chin guard and damper member, the latter being capable of reacting proportionally to impact intensity.

Preferably, the chin guard comprises side wings which embrace side portions of the cap and extend toward the bottom portion of the cap, at sides of the helmet. In such a case, damper members are positioned at both helmet sides in an intermediate position between each side wing of the chin guard and the side portions of the cap, so as to cushion the impact in a balanced manner at both sides.

As exemplary embodiments, said damper member comprises an insert of plastically-deformable material and/or of material with a honeycomb structure. Thus the damper member can achieve an improved degree of deformability and therefore an improved capability of absorbing impact energy, along with the ability of bringing the chin guard back toward its initial position when the acting force has ceased.

In one embodiment, the chin guard is pivoted on said cap so that the motion between the first and the second protecting position causes an angular displacement of the chin guard about an axis of rotation. This technical solution proves to be advantageous for the relative manufacturing simplicity and the opportunity of creating a movable, yet strong connection between chin guard and cap.

In a particular embodiment, the chin guard is pivoted on the cap at sides of the helmet, and even more particularly with an axis passing substantially at temporal portions of the cap, which in turn lie at the temporal region of the user's cranium. Thus, the center of rotation of the chin guard is placed as far as possible from the chin guard, i.e. as far as possible from the impact region on the chin guard, so as to achieve a high radius of curvature of the motion path of the chin guard. Thanks to this arrangement, the more the radius of curvature of the motion of the chin guard is high, the more the angular displacement of the chin guard can be approximated to a linear displacement, therefore to a translation, according to the component of the force acting in the direction of the chin, hence in the direction going from the chin guard to the bottom portion of the cap.

In other words, when the helmet is worn-on, the chin guard undergoes an angular displacement, similar to a horizontally pivoted motion, toward the bottom portion of the cap, in which the angular displacement has a wide radius of curvature and is comparable to a linear displacement along the tangent of the curved path traveled. In one embodiment, the chin guard is connected to the cap at both helmet sides by means of substantially L-shaped connecting arms, wherein each arm has a first section which is integrally connected to, or forms one piece with, the respective side wing of the chin guard, and a second section which is pivoted on the cap, preferably at the above-mentioned temporal portion.

The L-shape of the arms and their arrangement at the sides of the helmet achieves the further advantage of reducing to a minimum the stress transmission between chin guard and cap, as each of the arms has its own first section extending in a direction matching the direction of motion of the chin guard to the bottom portion of the cap. Stress transmission along the direction orthogonal to the direction of motion (i.e., along the second section of the L) is therefore reduced.

According to one embodiment, the helmet comprises a visor pivoted on said cap at the axis of rotation of the chin guard, this being to the advantage of manufacturing simplicity since the movable members are pivoted at one axis only.

In another embodiment, the chin guard is linearly displaceable with respect to the cap between the first protecting position and the second protecting position.

An advantage of such an embodiment is that it allows to define a direction of impact (i.e., that defined by the direction of translation) along which the capability of absorbing impact energy and acceleration is at a maximum.

In a particular embodiment, guide means (e.g., rails or tracks), which is preferably linear, is associated with the cap and counter-guide means (e.g., teeth, ribs or the like) is associated with the chin guard. The teeth run in the rails to guide the motion of the chin guard along said rails between said first and second protecting position. The guide means and counter-guide means may also be provided in a specularly-inverted position, i.e., the rails may be associated with the chin guard and the teeth may be associated with the cap.

In one embodiment, at each helmet side, each side wing of the chin guard is connected to a respective side portion of the cap by means of at least two connecting rods; in particular, each connecting rod is pivoted on the side wing at a first axis of rotation and is pivoted on the side portion of the cap at a second axis of rotation. Essentially, at each helmet side, the side wing of the chin guard, the side portion of the cap and the two connecting rods form an articulated quadrilateral.

This embodiment allows the chin guard to perform a rototranslatory motion. In a particular embodiment, the arrangement of the connecting rods is selected so that the rototranslatory motion comprises a translation and a concomitant rotation directed to the bottom portion of the cap. Thus, improved protection of the user's chin and effective interaction with the damper member are attained. The extents of the translation and rotation motions can be selected during the design stage, by suitably selecting the lengths of the connecting rods and their pivot points. Essentially, the motion of the chin guard between the first protecting position and the second protecting position occurs along a guided route, i.e., along a path predefined during the design stage of the helmet. This allows to control the path of the chin guard in order to prevent the latter from hitting the user's chin. Moreover, this allows to control how the impact force is absorbed or transmitted, depending on the acting direction of the force. For instance, the force component in the direction of motion of the chin guard moves the chin guard and therefore it is absorbed rather than transmitted to the cap, whereas the component orthogonal to the direction of motion is partially transmitted to the cap.

In other words, the path control, thanks to said guided route, allows to differentiate the response of the helmet to an acting force depending on the direction of incidence of the acting force.

The guided route is implemented thanks to guide means e/o counter-guide means, e.g. according to one of the systems described above: L-shaped arms pivoted to the cap, rails engaged by teeth, connecting rods forming an articulated quadrilateral.

For instance, the guided route is a rotation, a translation, or a rototranslation; the type of guided route is selected by the designer depending on the specific needs. Preferably, the guided route provides for a motion of the chin guard, between the first protecting position and the second protecting position, which is horizontally pivoted and directed downward, i.e. to the bottom portion of the cap.

It should be noted that the chin guard, during the motion following an impact, does not necessarily go as far as the second protecting position. In fact, depending on the energy of the impact, the chin guard may stop in an intermediate position between said first position and said second position, i.e., it stops in the position in which its kinetic energy is extinguished thanks to the absorption of energy by the damper member. In other words, the chin guard is able to assume a plurality of positions comprised between the extreme positions embodied by said first position and second position; the more the impact is violent, i.e., the more the force acting on the chin guard is intense, the more the stop position of the chin guard is near to the second protecting position.

In one embodiment, the helmet further comprises constraint means that can be deactivated; the constraint means is adapted to hold the chin guard in the first protecting position, and to allow motion of the chin guard toward the second protecting position when the acting force exceeds a threshold value. Thus, the chin guard is constrained and remains stationary with respect to the cap in all conditions of standard use (e.g., when the user carries the helmet holding it by the chin guard), whereas it executes its protecting function according to the present disclosure when it is subjected to an impact potentially injurious to the user.

In a particular embodiment, said constraint means comprises at least one gauged-breaking element, e.g. a tooth forming one piece with the cap and against which the chin guard abuts. Such a tooth element, in particular, lies along the motion path of the chin guard, so as to be broken by the chin guard during the motion. This solution combines manufacturing simplicity with the option of easily selecting the threshold value above which the motion of the chin guard is allowed.

In one embodiment, the helmet further comprises an end-of-stroke member adapted to keep the chin guard in the second protecting position, preventing it from overstepping the latter. This allows to prevent that, in case of impact, the chin guard may stop its travel against the user's chin; in fact, the end-of-stroke member sets a limit to the approaching of the chin guard to the chin.

In one embodiment, the end-of-stroke member is comprised of a pawl. In another embodiment, the end-of-stroke member is comprised e.g. of a raised contour formed on the cap, against which contour the chin guard abuts when reaching the second protecting position.

In an alternative embodiment, the overstepping of the second protecting position by the chin guard is prevented by the damper member itself, which does not allow to be compressed beyond a certain limit, said limit corresponding to the second protecting position.

In one embodiment, the chin guard internally comprises, facing the user's chin, a recess having an arc-shaped transversal contour and having a size sufficient to cause the user's chin not to be in contact with the chin guard in said second protecting position. Such a recess allows the chin to be protected during the motion of the chin guard, creating a sort of "survival space" therefor.

Further advantages, characteristic features and the modes of use of what has been described will become clear from the following detailed description of preferred embodiments thereof, provided solely by way of a non-limiting example.

It is clear, however, that each embodiment described in the present disclosure may have one or more of the advantages listed above; in any case it is not required that each embodiment should have simultaneously all the advantages listed.

Reference shall be made to the figures of the accompanying drawings in which.

With reference to the above-mentioned figures, reference number 1 denotes a helmet for protecting a user's head 90.

Figure 1:
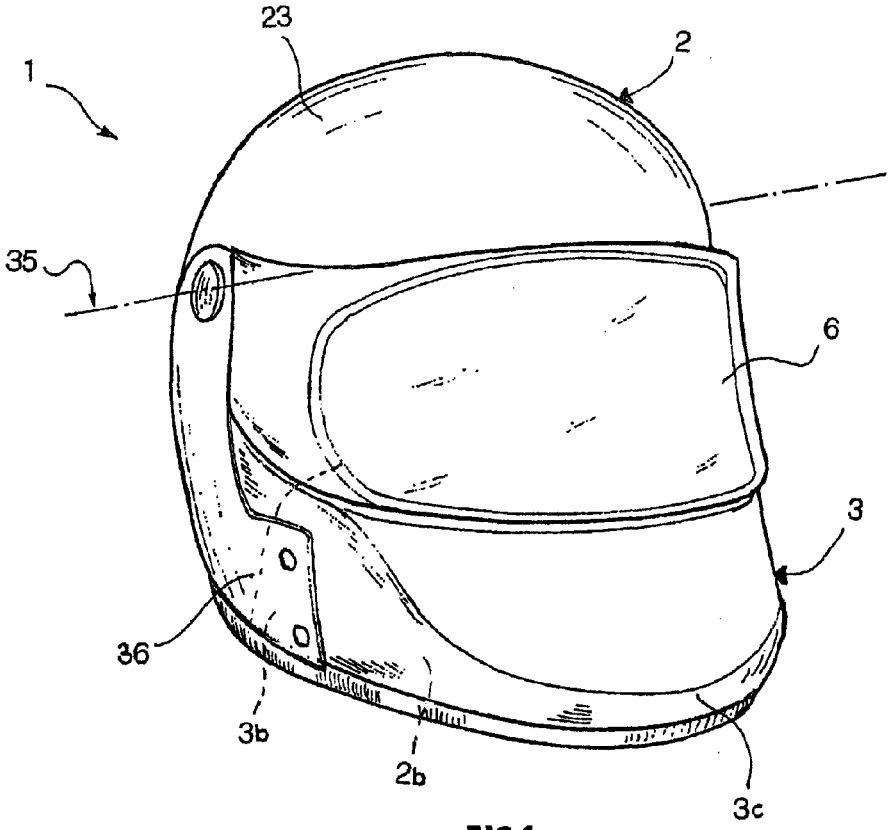
FIG. 1 depicts a three-quarter perspective view of a first embodiment of a protecting helmet according to the present disclosure.
Figure 2:
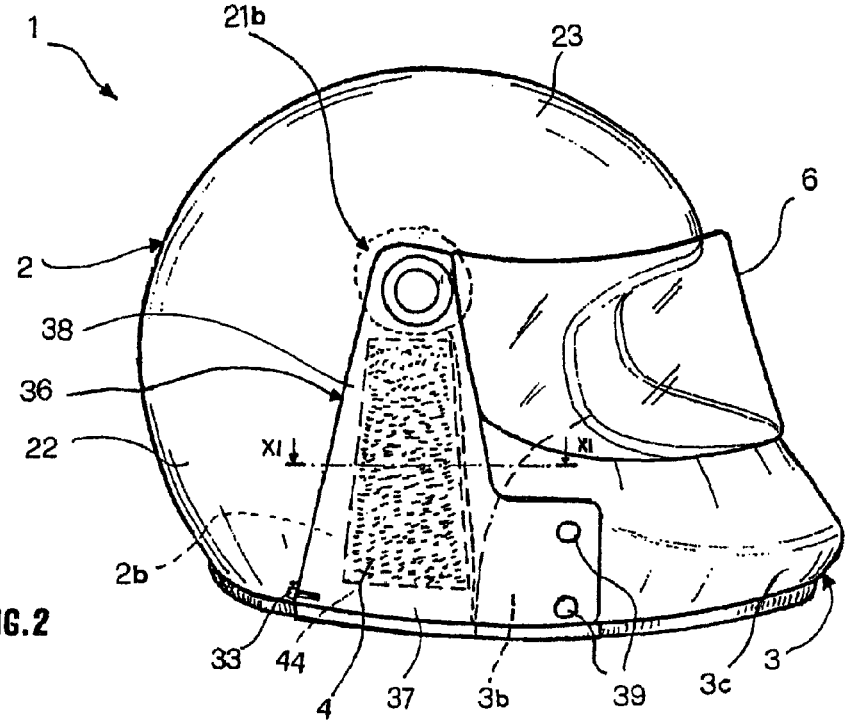
FIG. 2 depicts a side view of the helmet of FIG. 1.
Figure 3:
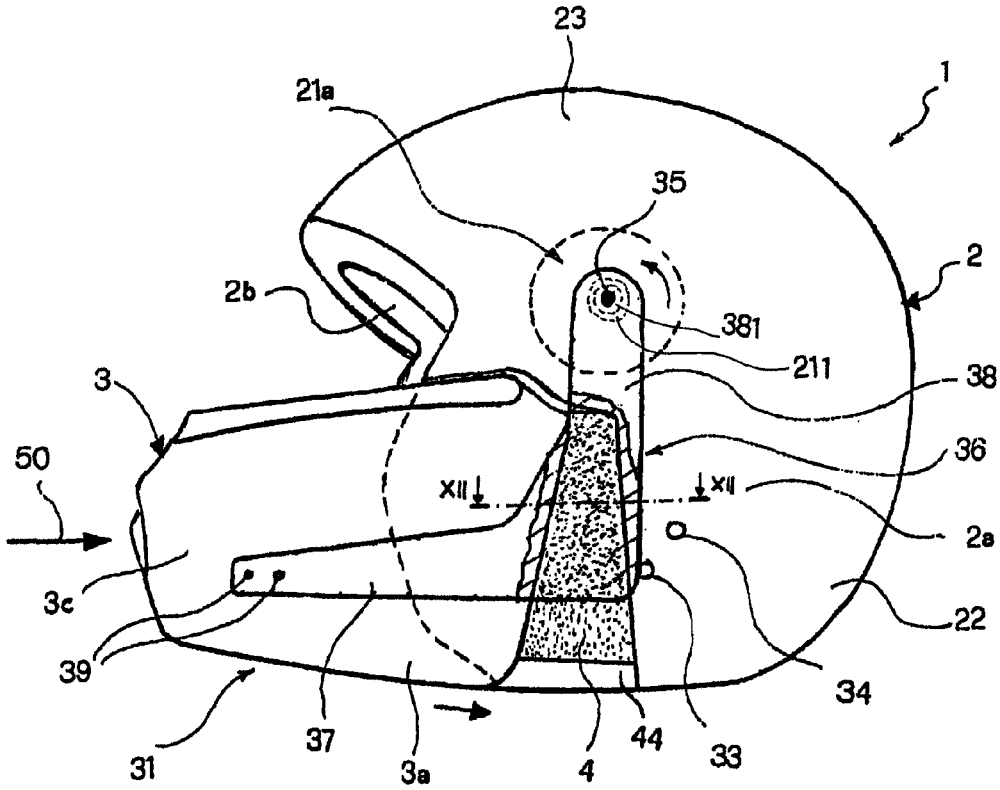
FIG. 3 depicts a schematic and partially sectional side view of a second embodiment of a protecting helmet according to the present disclosure, in a first protecting position thereof.
Figure 4:
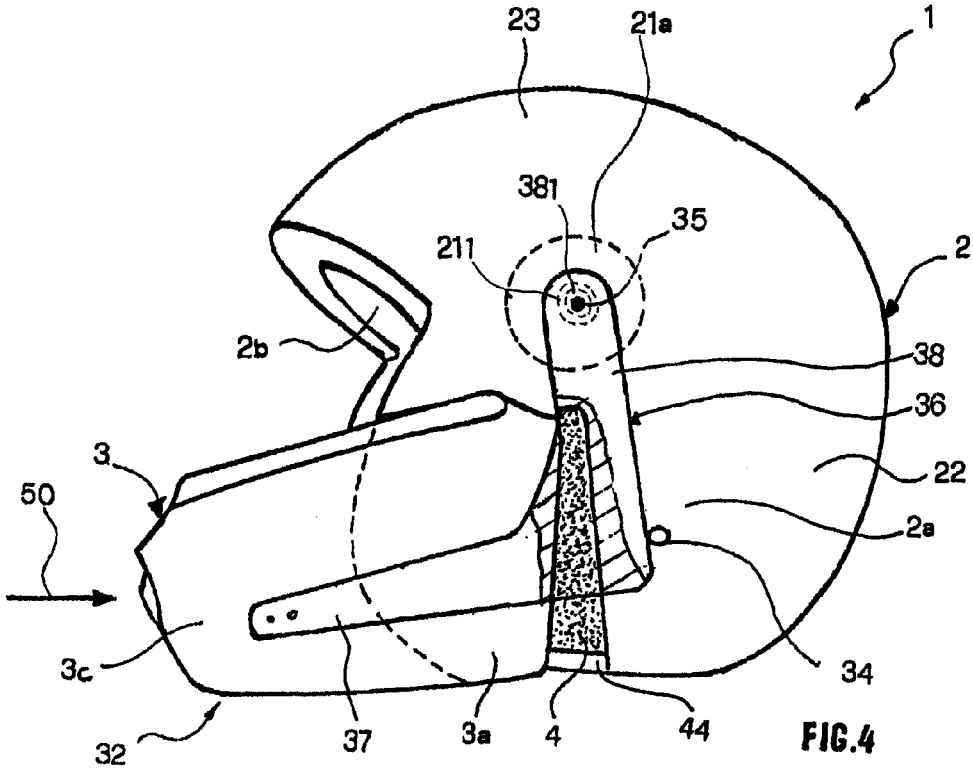
FIG. 4 depicts a schematic and partially sectional side view of the helmet of FIG. 3, in a second protecting position thereof.

FIGS. 1 and 2 show a first embodiment of a helmet 1, whereas FIGS. 3 and 4 show a second embodiment of a helmet 1. The two embodiments will be described jointly, with the same reference numbers, as they have differences such as not to require a separate detailed description. In particular, such differences are indicated each time in the course of the description.

Moreover, for the sake of simplicity in the wording, the following description is made with reference to the position of the helmet when the latter is worn on by the user; therefore, any indication such as "top", "bottom", "front", "rear" and the like are to be interpreted in connection with this condition in which the helmet is worn on, and also the helmet portions indicated make reference to the position they assume when placed at the user's head 90 or cranium 92.

The helmet 1 for protecting a user's head 90 comprises a cap 2 for protecting the user's cranium 92 and a chin guard 3 for protecting the user's chin 93, wherein the cap 2 includes a bottom portion 22 positioned at the rear of the user's cranium and/or user's nape; the bottom portion 22 is substantially opposite to the chin guard 3.

In particular, the cap 2 is formed by a shell having a substantially arcuate and/or spherical shape, including, besides the above-mentioned bottom portion 22, side portions 2*a*, 2*b* placed at the sides or flanks of the cranium and temporal regions thereof. The side portions 2*a*, 2*b* are denoted by a dashed line with reference numbers 21*a* and 21*b*. The cap 2 further comprises a top portion 23 extending from the bottom portion 22 to near the user's forehead 96.

The chin guard 3 comprises a substantially C-shaped shell having a central portion 3*c*, positioned in front of the user's chin 93, and side wings 3*a*, 3*b*. The side wings 3*a*, 3*b* extend from the central portion 3*c*, along the sides of the helmet 1, and laterally and externally embrace the cap 2 at the respective side portions 2*a*, 2*b*, toward the bottom portion 22.

The chin guard 3 is structurally independent from the cap 2 and it is connected thereto so as to move between a first protecting position 31 (shown in FIG. 3) and a second protecting position 32 (shown in FIG. 4). When the chin guard 3 is in the second protecting position 32, it is displaced, nearing the bottom portion 22 of the cap 2 and therefore the central portion 3*c* of the chin guard 3 is nearer to the chin 93 of the user wearing on the helmet 1, with respect to when the chin guard 3 itself is in the first protecting position 31.

Essentially, the chin guard 3 is capable of moving with respect to the cap 2 along a guided route. It should be noted that in FIG. 4 the extent of said motion has been enhanced to the advantage of a greater clarity in the explanation.

During standard use, the chin guard 3 is in the first protecting position 31 (FIGS. 2 and 3). Following a force 50 acting along at least one direction going from said chin guard 3, in particular from the central portion 3*c* of said chin guard 3, to said bottom portion 22 of the cap 2, therefore to the user's chin 93, like, e.g., in case of impact following an accident, the chin guard 3 moves from the first protecting position 31 to the second protecting position 32.

The chin guard 3 is normally held in the first protecting position 31 by suitable constraint means that can be deactivated; the constraint means is adapted to allow motion of the chin guard 3 toward the second protecting position 32 only when the force 50 acting in the direction of the chin 93 exceeds a threshold value.

Thus, the chin guard 3 can normally be stationary with respect to the cap 2, so as to allow, e.g., the user to carry the helmet 1 grabbing it by the chin guard 3. However, when the force 50 acting on the chin guard exceeds a certain threshold value, which is selected so that it corresponds to an impact force potentially injurious to the user, said constraint means cease their function and free the motion of the chin guard 3, which moves toward the cap 2 along said guided route.

For instance, said constraint means that can be deactivated comprises at least one gauged-breaking element, such as a tooth 33 formed on the surface of the cap 2 at the side portions 2*a*, 2*b*.

The helmet 1 further comprises an end-of-stroke member to prevent the chin guard 3 from overstepping the second protecting position 32. In case of a violent impact, the chin guard 3 might in fact tend to overstep the second position 32, with the risk that it may impact forcefully against the user's chin 93. Then, to prevent this, the end-of-stroke member, such as e.g. a pawl 34, is provided and it prevents the chin guard 3 from overstepping a limit position. In this case, a pawl 34 is arranged on each side portion 2*a*, 2*b* of the cap 2, beyond the constraint element 33, toward the bottom portion 22 of the cap 2.

The helmet 1 further comprises a damper member 4 (shown in phantom lines in FIG. 2) cooperating with the chin guard 3 during the motion of the chin guard 3 between the first protecting position 31 and the second protecting position 32, wherein this damper member 4 is adapted to absorb mechanical energy following the impact or an acting force. Therefore, energy transfer occurs between the chin guard 3 and the damper member 4, so that a share of impact energy is not transmitted to the user's head 90, but it is instead dissipated or accumulated by the damper member 4 during said motion of the chin guard 3.

In the example, the damper member 4 is formed by an insert, substantially bellows-shaped, which therefore carries out the function of dampening the impact force developing in case of impact on the chin guard 3 of the helmet 1.

In the embodiment shown in FIGS. 1, 2, 3 and 4, the damper member 4 is interposed between the respective side portions 2*a* and 2*b* of the cap 2 and the side wings 3*a*, 3*b* of the chin guard 3, so as to be subjected to a compressive action by end edges of the side wings 3*a*, 3*b* of the chin guard 3, during the motion of the chin guard 3 between the first position 31 and the second position 32.

Figure 11:
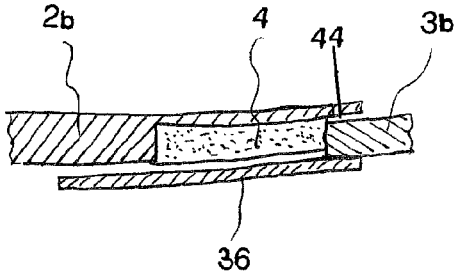
FIG. 11 depicts a sectional view of the helmet in FIG. 2 along section line XI-XI.
Figure 12:
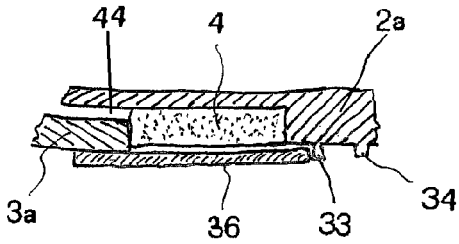
FIG. 12 depicts a sectional view of the helmet in FIG. 3 along section line XII-XII.

In the embodiment of FIGS. 1, 2, 3 and 4, the damper member 4 is housed in a suitable seat 44 formed on the side portions 2*a* and 2*b* of the cap 2, where corresponding side wings, respectively 3*a*, 3*b*, of the chin guard 3 embrace the cap 2. The damper member 4 projects externally with respect to the surface of the cap 2 so as to be compressed, as mentioned, by the end edges of the side wings 3*a* and 3*b* of the chin guard 3 during said motion. In the example the damper member 4 is glued on one side to the side portions 2*a*, 2*b* of the cap 2, and on the other side to the end edges of the side wings 3*a* and 3*b* of the chin guard 3 (as seen in FIGS. 11 and 12).

As exemplary embodiments, the damper member 4 may be made of plastically deformable material and/or may have a honeycomb structure.

In any case, it is evident that, also thanks to the resistance opposed by the damper member 4, depending on the strength of the force 50, the chin guard 3 might not reach the second protecting position 32, but might stop at a position intermediate between the position 31 and the position 32.

The motion of the chin guard 3 between the first position 31 and the second position 32 takes place substantially in the direction of the bottom portion 22, then of the user's chin 93, coherently with the direction of the impact force 50 of which it is desirable to minimize the effects.

In particular, the chin guard 3 is pivoted on the cap 2 of the helmet 1 via pivot means pivotable about an axis of rotation 35: therefore, the motion between the first position 31 and the second position 32 is an angular displacement about said axis of rotation 35.

In the embodiment shown, the chin guard 3 is pivoted on the cap 2 substantially at the temporal regions 21*a*, 21*b* of the cap 2, i.e., as mentioned, substantially at the regions of the cap 2 corresponding to the temples of the user wearing on the helmet 1. Therefore said axis of rotation 35 of the chin guard 3 passes through both the temporal regions 21*a* and 21*b*.

In case the helmet 1 comprises also a visor 6, in turn pivoted on the cap 2, as in the embodiment of FIGS. 1 and 2, the visor 6 and the chin guard 3 may be pivoted at the same axis of rotation 35.

It should be noted that the axis of rotation 35 of the chin guard 3 is arranged as far as possible from the impact region (i.e., from the region of the chin 93), so that the motion of the chin guard 3 has a radius of curvature as high as possible; thus, the motion of the chin guard 3 between said first and second position can be comparable to a greater extent to a translation motion toward the chin 93 along the tangent to said curvature.

Preferably, the helmet 1 comprises connecting arms 36 for connecting the chin guard 3 to the cap 2, wherein each of said connecting arms 36 is substantially L-shaped; each of the connecting arms 36 further acts as a guide of the chin guard 3 along said guided route.

Each connecting arm 36 is arranged on a respective side of the helmet 1, so as to at least partially cover the damper member 4.

In particular, a first section 37 of the connecting arm 36 is substantially arranged integral, and substantially parallel, to the respective side wing 3*a*, 3*b* of the chin guard 3, therefore it lies in the direction of motion of the chin guard 3; a second section 38 of the connecting arm 36 extends orthogonally to the first section 37 along the side portion 2*a*, 2*b* of the cap 2 toward the temporal region 21*a*, 21*b*, and it has an end portion pivoted at the axis of rotation 35.

This arrangement allows the acting force 50 due to the impact to be capable of setting the chin guard 3 into rotation, pushing it to the bottom portion 22 of the cap 2 (as seen in FIG. 4, the side wings 3*a*, 3*b* are closer to the bottom portion 22), also independently from the angle formed between the direction of the force 50 and the central portion 3*c* of the chin guard 3, whereas any components of the force that may be transmitted to the cap 2 (and in particular to the axis of rotation 35 of the chin guard 3) in the direction of the second section 38 are reduced to a minimum. Basically, the angular displacement is a substantially horizontally-pivoted motion of the chin guard 2 in the direction of the rear bottom portion 22 of the cap 2; in the case at issue, the horizontally-pivoted motion takes place downward. Thanks to this horizontally-pivoted motion, the knock is dampened, and the transmission of the knock to the cap 2 is reduced to a minimum.

It should be noted that in the example the connecting arm 36 is formed by a bracket fastened to the chin guard 3, e.g. by means of rivets 39, and pivoted to the cap 2 by means of a rotoidal pair, shown with dashed line in FIGS. 3 and 4.

Said rotoidal pair comprises, on each side portion 2*a*, 2*b*, a pivot 381 integral with the second section 38 of the connecting arm 36; said pivot 381 extends orthogonally to the second section 38 toward the respective side portion 2*a*, 2*b* of the cap. The rotoidal pair further comprises, on each side portion 2*a*, 2*b*, a housing member 211 fastened to the cap 2 and provided with a housing or seat adapted to receive said pivot 381, so as to allow rotation of the pivot 381 with respect to the housing member 211 about the axis 35. The manufacturing of said rotoidal pair is however to be deemed within the technical competence of a person skilled in the art.

In other words, the pivot 381 and the housing member 211 embody said pivot means pivotable about an axis of rotation 35, allowing to move the chin guard 3 between the first protecting position 31 and the second protecting position 32 along a guided route. Therefore, the connecting arms 36 and said rotoidal pairs are guide means and counter-guide means of the motion of the chin guard 3.

The bracket has a first shape like that shown in FIGS. 1 and 2, or another shape like that illustrated in FIGS. 3 and 4. The bracket may be made of aluminum.

It should be noted from FIGS. 2 and 3 that the connecting arm 36, at its angle portion, abuts against the above-mentioned constraint tooth 33.

Alternatively, in an embodiment not illustrated, the same chin guard 3 may form one piece with two L-shaped arms, by means of which it is pivoted on the cap 2.

It should also be noted that, in principle, the chin guard 3 might be pivoted at a region nearer to the top, or top portion 23, of the helmet 1, but this proves more inconvenient and less effective, since the connecting arm between the chin guard 3 and the axis of rotation 35 should follow the arcuate/spherical shape of the cap 2; moreover, said arcuate/spherical shape itself might hinder or limit the rotation of the chin guard 3 with respect to the cap 2.

Figure 5:
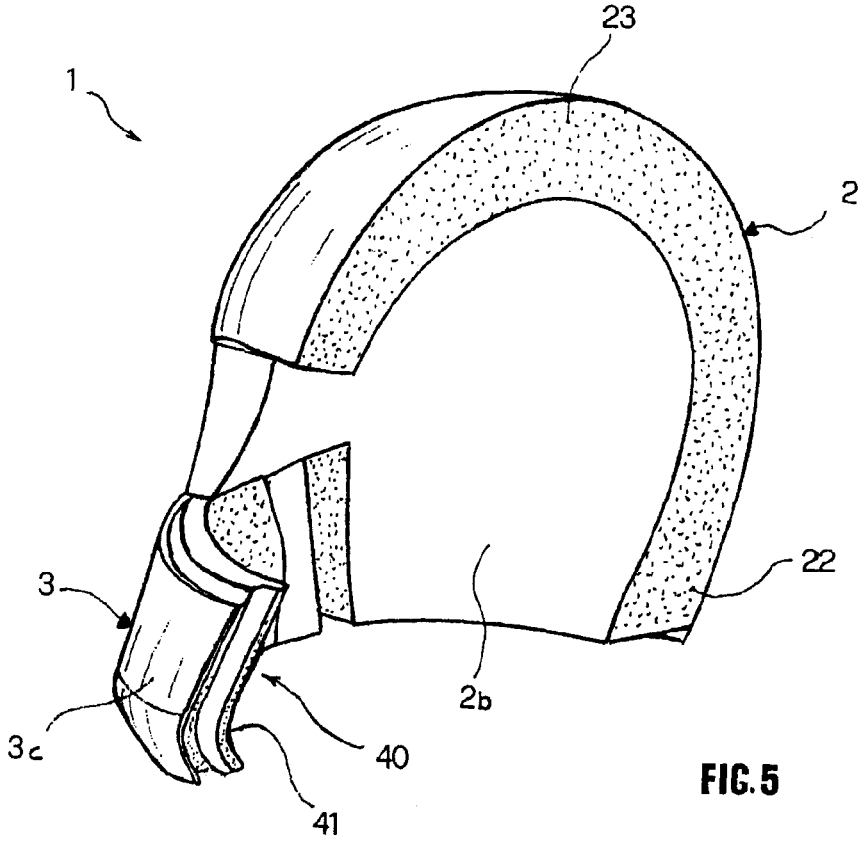
FIG. 5 depicts a three-quarter sectional view of the helmet of FIG. 1.
Figure 6:
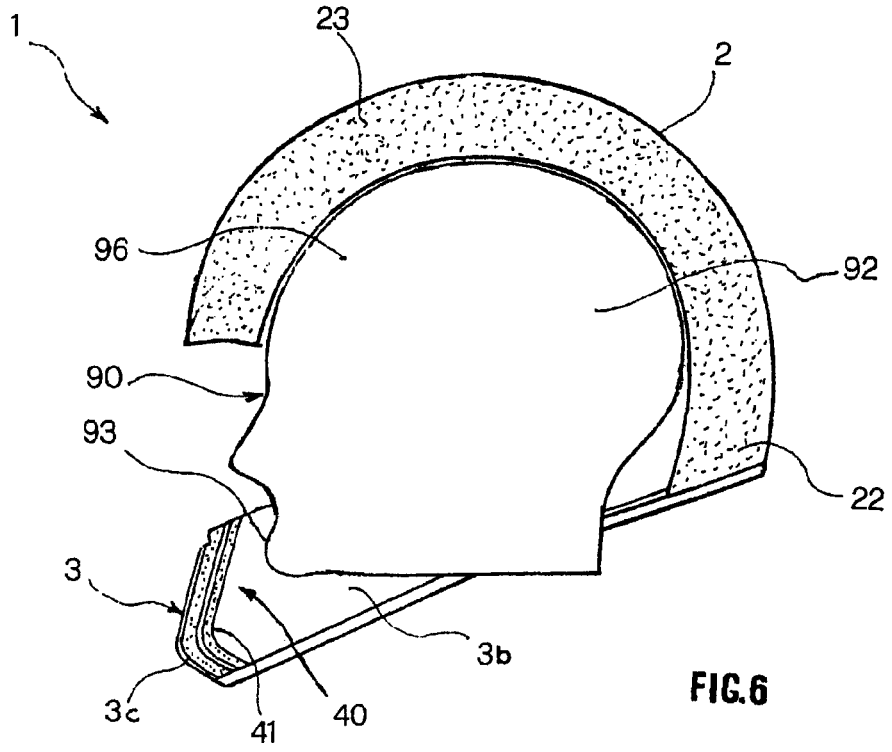
FIG. 6 depicts a sectional side view of the helmet of FIG. 1.

As shown in the sectional views in FIGS. 5 and 6, the chin guard 3 may internally have a recess 40 having an arc-shaped transversal contour 40. Such a recess 40 allows the chin 93 to have a "survival" space, to prevent the chin 93 from coming into contact with the chin guard 3 when the latter is in said second protecting position 32.

Figure 7:
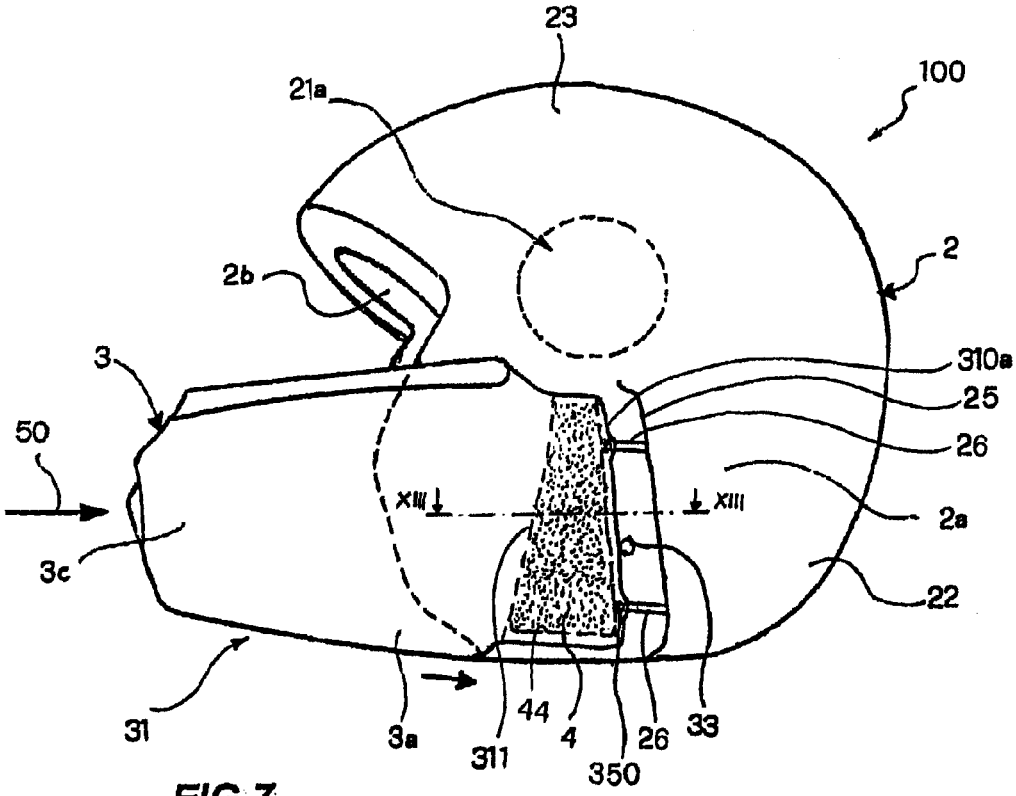
FIG. 7 depicts a schematic side view of a third embodiment of a protecting helmet according to the present disclosure, in a first protecting position thereof.
Figure 8:
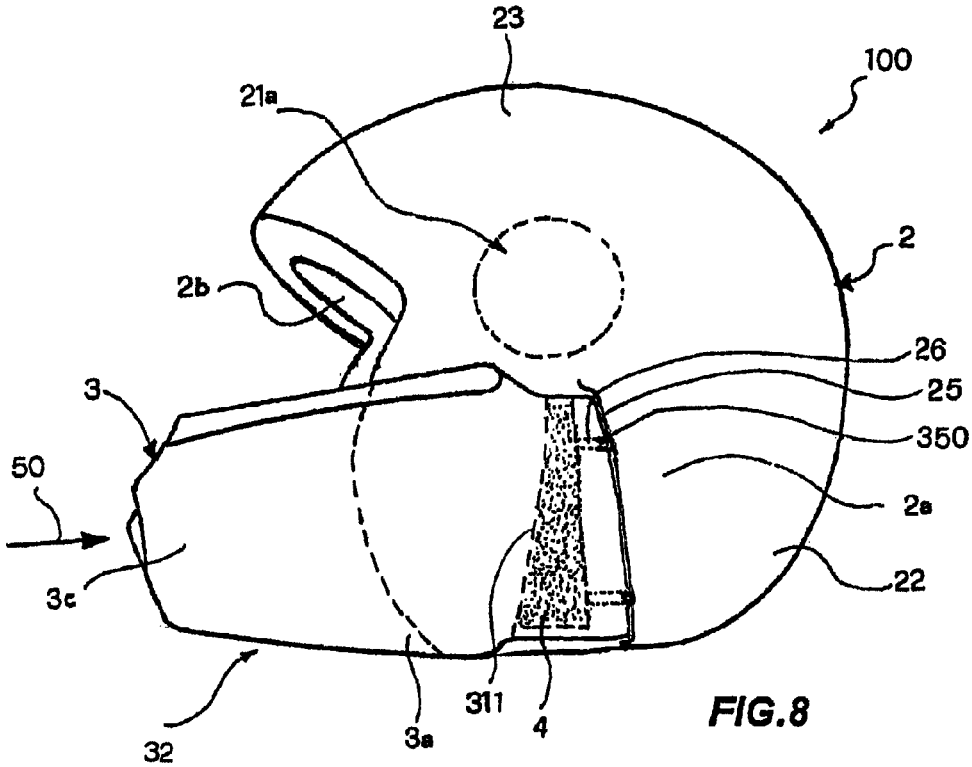
FIG. 8 depicts a schematic side view of the helmet of FIG. 7, in a second protecting position thereof.

FIGS. 7 and 8 show another embodiment of a helmet according to the present disclosure, denoted by reference number 100. In said embodiment, elements having the same function and structure maintain the same reference number of the aforedescribed embodiment, therefore they are not detailed again.

The helmet 100 comprises a chin guard 3 which is adapted to move with respect to the cap 2 between a first protecting position 31 and a second protecting position 32 along a guided route, performing a translation motion.

In particular, said guided route is defined by guide means associated with the cap 2: said guide means is, e.g., rails 26 formed on the external surface of the side portions 2*a*, 2*b* of the cap 2, or rails fastened to the external surface of the side portions 2*a*, 2*b* themselves. The rails 26 are engaged by counter-guide means associated with the chin guard 3, e.g., teeth 350 integral with the side wings 3*a*, 3*b* of the chin guard 3, so that the chin guard 3 be guided to slide along said rails 26. Preferably, said guide means and counter-guide means 26, 350 are of linear type and are such as to allow the chin guard 3 to move along a translation between the first position 31 and the second position 32, thanks to the cooperation between the guide means and the counter-guide means.

Alternatively, the positions of the guide means and counter-guide means may be inverted, i.e. the rails 26 may be borne by the side wings 3*a*, 3*b* of the chin guard 3, whereas the teeth 350 may be integral with the side portions 2*a*, 2*b* of the cap 2. Analogously to what has been already described in the foregoing, it is provided a gauged-breaking element, like e.g. a tooth 33 formed on the surface of the cap 2, at the side portions 2*a*, 2*b*, in order to hold the chin guard 3 in the first protecting position 31.

Moreover, in this embodiment it is shown an end-of-stroke member for preventing the chin guard 3 from overstepping the second protecting position 32. The end-of-stroke member comprises a raised contour 25 formed on each side portion 2*a*, 2*b* of the cap 2. When the chin guard reaches the second position 32, edges 310*a*, 310*b* of the respective wings 3*a*, 3*b* abut against such raised contours 25, preventing further motion of the chin guard 3 toward the bottom portion 22 of the cap 2.

In an alternative embodiment, the overstepping of the second protecting position 32 by the chin guard 3 is prevented by the damper member 4 itself, which does not allow to be compressed beyond a certain limit; this limit corresponds to the second protecting position 32.

Figure 13:
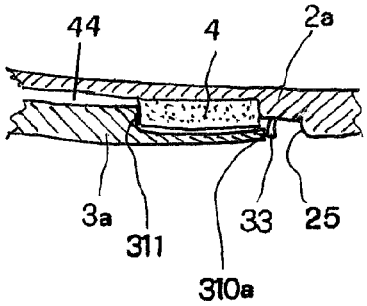
FIG. 13 depicts a sectional view of the helmet in FIG. 7 along section line XIII-XIII.
Figure 14:
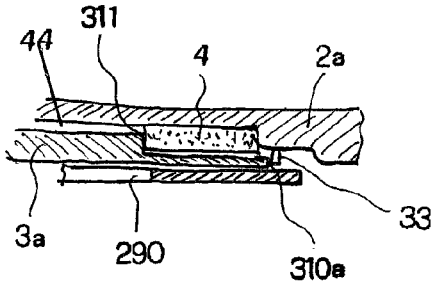
FIG. 14 depicts a sectional view of the helmet in FIG. 9 along section line XIV-XIV.

In the example the side wing 3*a*, 3*b* of the chin guard 3 covers the damper member 4, which therefore remains in the seat 44 and is interposed between the external surface of the respective side portion 2*a*, 2*b* of the cap 2 and the internal surface of the side wing 3*a*, 3*b*. In this case, the compressive action on the damper member 4 is exerted by the chin guard 3 by means of a raised contour 311, or shoulder, formed on the internal surface of the side wing 3*a*, 3*b*; during said motion the raised contour 311 abuts against the damper member 4, compressing it into the seat 44 (FIG. 13).

Figure 9:
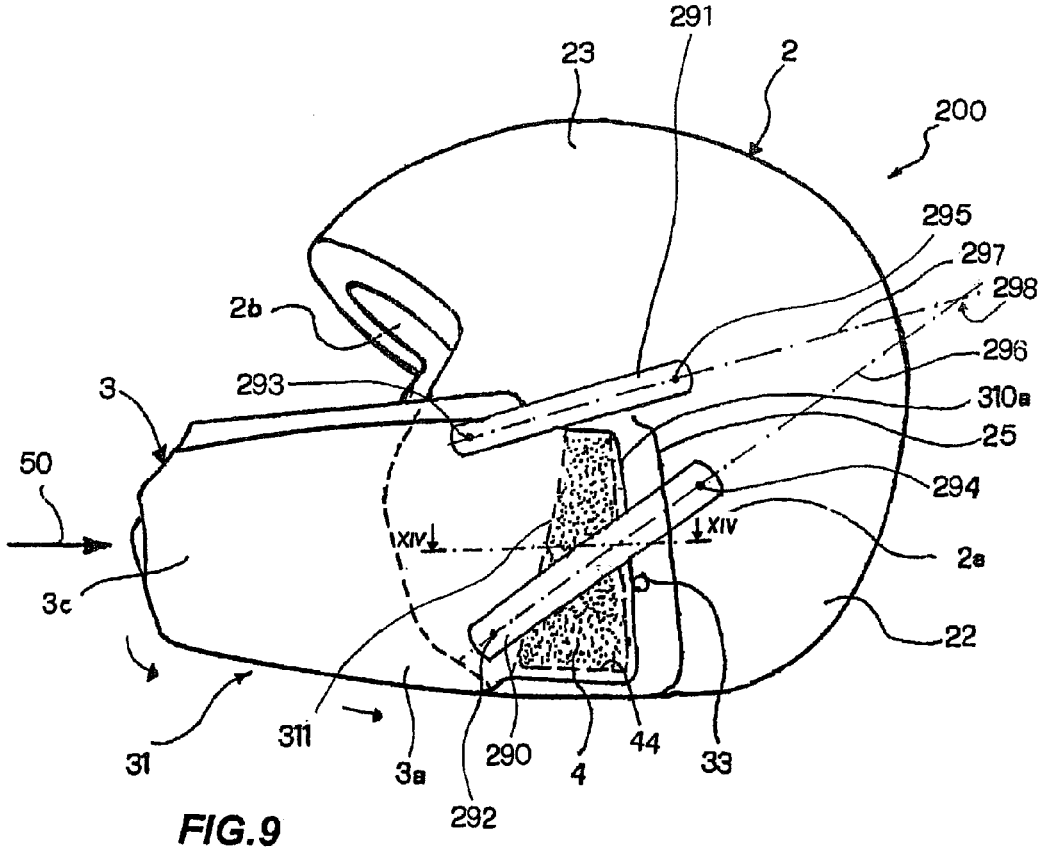
FIG. 9 depicts a schematic side view of a fourth embodiment of a protecting helmet according to the present disclosure, in a first protecting position thereof.
Figure 10:
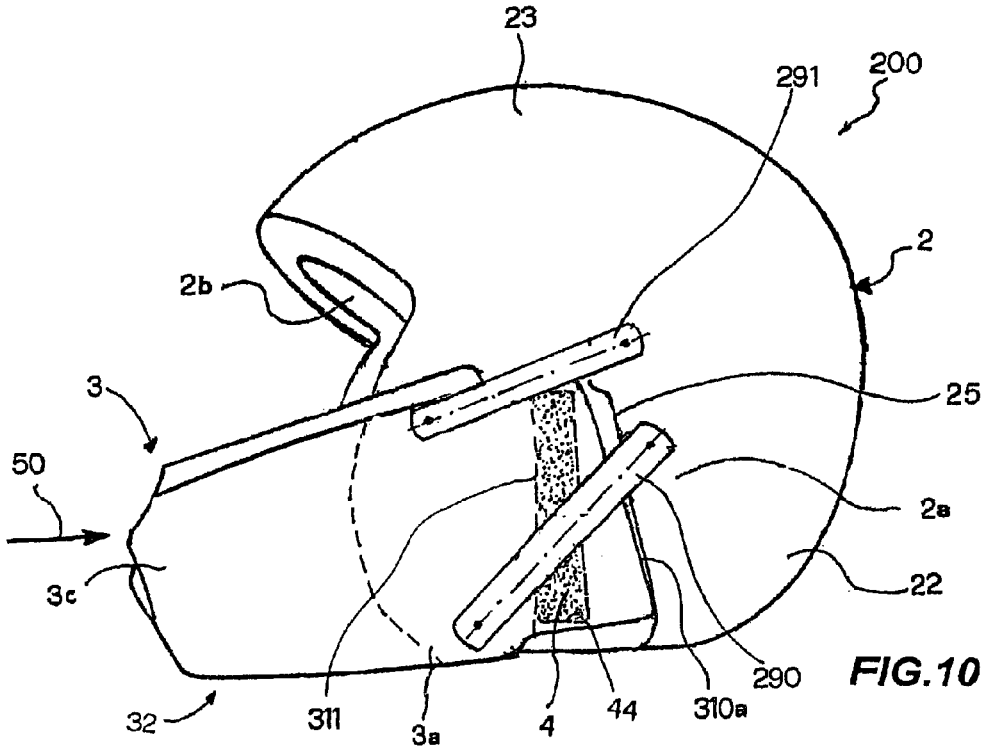
FIG. 10 depicts a schematic side view of the helmet of FIG. 9, in a second protecting position thereof.

FIGS. 9 and 10 show yet another embodiment of a helmet according to the present disclosure, denoted by reference number 200. In this embodiment as well, elements having the same function and structure maintain the same reference number of the aforedescribed embodiments and therefore they are not detailed again.

In this embodiment, the chin guard 3 is connected to the cap 2 so that the motion between the first protecting position 31 and the second protecting position 32 is a guided motion of rototranslatory type. In the example, each of the side wings 3*a*, 3*b* of the chin guard 3 is connected to the respective side portion 2*a*, 2*b* of the cap 2 by means of at least two connecting rods 290, 291.

Each connecting rod 290, 291 is pivoted to the respective side wing 3*a*, 3*b* of the chin guard 3 at a respective first axis of rotation 292, 293; moreover, it is pivoted to the respective side portion 2*a*, 2*b* of the cap 2 at a respective second axis of rotation 294, 295. It should be noted that in FIG. 9 said axes of rotation 292, 293, 294, 295 are substantially orthogonal to the plane of the drawing, and therefore only their intercepts with the plane of the drawing itself are shown.

On each side of the helmet 200, the side wing of the chin guard 3, the side portion of the cap 2 and the connecting rods 290, 291 form an articulated quadrilateral, allowing a desired rototranslation of the chin guard 3 with respect to the cap 2.

The connecting rods 290, 291, are arranged so that said first and second axes of rotation are all distinct therebetween. Moreover, they are arranged so as to converge to the back of the cap 2. In particular, considering a plane 296 containing the first axis 292 and the second axis 294 of rotation of a first connecting rod 290, and a plane 297 containing the first axis 293 and the second axis 295 of rotation of the second connecting rod 291, said planes 296 and 297 converge into a region 298 which lies beyond the cap 2 in a direction opposite to the chin guard 3. This region 298 is, e.g., placed in the rear of the helmet 200, behind the user's nape.

Also the planes 296, 297 are substantially orthogonal to the plane of the drawing of FIG. 9; therefore, FIG. 9 shows only the intercepts thereof with the plane of the drawing.

Such an arrangement of the connecting rods 290, 291 allows the chin guard 3 to follow a rototranslatory motion, comprising a translation directed toward the bottom portion 22 of the cap 2 and concomitantly a rotation (counterclockwise in FIG. 9), so as to protect the chin in the most effective way.

The connecting rods 290, 291 and the respective rotoidal pairs for pivoting on the cap 2 and on the chin guard 3 embody, therefore, guide means and/or counter-guide means for having the chin guard 3 traveling along said guided route.

In this case as well, the compressive action on the damper member 4 is exerted by the chin guard 3 by means of a raised contour 311, or shoulder, formed on the internal surface of the side wing 3*a*, 3*b*, which during said motion abuts against the damper member 4.

The subject of the present disclosure has been hereto described with reference to preferred embodiments thereof. It is understood that other embodiments might exist, all of these falling within the scope of protection of the claims which are provided hereinbelow.

The invention claimed is:

1. A helmet for protecting a user's head, comprising a cap for protecting the user's cranium comprising a cap side area distinct from a cap back area and a chin guard for protecting the user's chin comprising a chin guard front area distinct from a chin guard side area, wherein the cap comprises at least one bottom portion positioned, in operation, at the rear of the user's cranium and/or user's nape, and substantially opposite to the chin guard, wherein the chin guard is adapted to move with respect to the cap between a first protecting position and a second protecting position under action of a force acting on the chin guard and having at least one component directed toward said bottom portion of the cap, wherein the chin guard in said second protecting position is at least partially displaced, nearing said bottom portion of the cap with respect to said first protecting position so as to be nearer to the user's chin during operation, and wherein the helmet further comprises a damper member cooperating with the chin guard during motion between the first protecting position and the second protecting position, the damper member being an insert made of a material selected from a plastically deformable material, a honeycomb material or a bellows shaped material, the insert being located on a side of the helmet, substantially all between the chin guard side area and the cap side area, the insert being configured to be subjected to a compressive action during the motion of the chin guard between the first protecting position and the second protecting position.

2. The helmet according to claim 1, wherein said chin guard comprises a substantially C-shaped shell, with a central portion and two side wings, wherein said side wings embrace corresponding side portions of the cap, and wherein said insert located on a side of the helmet is included between a respective side wing and the corresponding side portion of the cap.

3. The helmet according to claim 1, further comprising pivot means pivotable about a determined axis for connecting the chin guard to said cap, said motion between the first protecting position and the second protecting position being an angular displacement about said axis.

4. The helmet according to claim 3, wherein said pivot means is arranged substantially at temporal regions of the cap, said axis passing through both said temporal regions.

5. The helmet according to claim 3, further comprising at least one substantially L-shaped connecting arm connecting said chin guard to said cap, said arm having a first section integrally connected with the chin guard and a second section pivoted on the cap via said pivot means.

6. The helmet according to claim 3, further comprising a visor pivoted to said cap at said axis.

7. The helmet according to claim 1, further comprising guide means associated with said cap and counter-guide means associated with said chin guard, said guide means being adapted to cooperate with said counter-guide means to guide the motion of the chin guard between the first protecting position and the second protecting position.

8. The helmet according to claim 7, wherein said guide and counter-guide means are linear, such that said motion of the chin guard is a translation motion.

9. The helmet according to claim 7, wherein said guide means comprises rails and said counter-guide means comprises teeth adapted to engage said rails.

10. The helmet according to claim 1, wherein said chin guard comprises a substantially C-shaped shell, with a central portion and two side wings, wherein each of said side wings is associated with a corresponding side portion of the cap at a side of the helmet, wherein each of said side wings is connected to a respective side portion of the cap by at least two connecting rods and each of said connecting rods is pivoted on said side wing of the chin guard at a first axis of rotation and is pivoted on the respective side portion of the cap at a second axis of rotation, such that, at each side of the helmet, said connecting rods, said side wing of the chin guard, and said side portion of the cap form an articulated quadrilateral.

11. The helmet according to claim 10, wherein a plane containing said first axis and said second axis of rotation of a first connecting rod and a plane containing said first axis and said second axis of rotation of a second connecting rod converge into a region beyond said cap in a direction opposite to said chin guard.

12. The helmet according to claim 1, further comprising constraint means interposed between the chin guard and the cap for holding the chin guard in said first protecting position, wherein said constraint means can be deactivated, when said force exceeds a threshold value, to allow motion of the chin guard to the second protecting position.

13. The helmet according to claim 12, wherein said constraint means comprises at least one gauged-breaking element.

14. The helmet according to claim 1, further comprising an end-of-stroke member associated to the cap adapted to limit the displacement of the chin guard, keeping the chin guard in said second protecting position.

15. The helmet according to claim 1, wherein the chin guard internally comprises a recess having an arc-shaped transversal contour, adapted to cause, during operation, the user's chin not to be in contact with the chin guard in said second protecting position.

16. The helmet according to claim 1, wherein said chin guard comprises a substantially C-shaped shell having a central portion and two side wings, each side wing embracing a respective side portion of the cap, wherein the insert located on a side of the helmet is housed in a seat made on a respective side portion of the cap, the insert being projecting externally from a surface of the cap, an edge of a respective side wing being configured to exert said compressive action on the insert during the motion of the chin guard between the first protecting position and the second protecting position.

17. The helmet according to claim 1, wherein said chin guard comprises a substantially C-shaped shell having a central portion and two side wings, each side wing embracing a respective side portion of the cap, wherein the insert located on a side of the helmet is included between a respective side portion of the cap and a respective side wing which covers the insert, the insert being positioned between an internal surface of the respective side wing and an external surface of the respective side portion of the cap, wherein the internal surface of the respective side wing comprises a raised contour or shoulder which abuts against the insert, the raised contour or shoulder being configured to exert said compressive action on the insert during the motion of the chin guard between the first protecting position and the second protecting position.

* * * * *

UNITED STATES PATENT AND TRADEMARK OFFICE

CERTIFICATE OF CORRECTION

PATENT NO. : 8,667,618 B2
APPLICATION NO. : 13/056114
DATED : March 11, 2014
INVENTOR(S) : Pierini et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 306 days.

Signed and Sealed this
Twenty-ninth Day of September, 2015

Michelle K. Lee

Michelle K. Lee
*Director of the United States Patent and Trademark Office*